United States Patent [19]

Black et al.

[11] 4,061,443

[45] Dec. 6, 1977

[54] VARIABLE STROKE COMPRESSOR

[75] Inventors: Dennis A. Black, Dayton; Byron L. Brucken, Miamisburg, both of Ohio

[73] Assignee: General Motors Corporation, Detroit, Mich.

[21] Appl. No.: 747,043

[22] Filed: Dec. 2, 1976

[51] Int. Cl.[2] ..... F04B 1/26; F04B 1/12; F01B 13/04; F16H 23/00

[52] U.S. Cl. ..... 417/222; 92/12.2; 417/269; 184/6.17; 74/60

[58] Field of Search ..... 417/218, 222, 269; 91/506; 92/12.2; 74/60

[56] References Cited

U.S. PATENT DOCUMENTS

| | | | |
|---|---|---|---|
| 2,711,135 | 6/1955 | Dunlap | 417/222 |
| 2,955,475 | 10/1960 | Zubaty | 417/222 |
| 2,964,234 | 12/1960 | Loomis | 74/60 |
| 3,062,020 | 11/1962 | Heidorn | 62/196 |

*Primary Examiner*—Carlton R. Croyle

*Assistant Examiner*—G. P. LaPointe

*Attorney, Agent, or Firm*—Edward P. Barthel

[57] ABSTRACT

A wobble plate compressor in which the output of the compressor is modulated in response to refrigeration requirements by varying the compressor piston displacement to match the cooling requirement. An expansible chamber power unit including a sleeve surrounds the drive shaft in sealing relation therewith for axial movement with said sleeve including a wobble plate connected thereto for pivotal movement relative to the shaft. The wobble plate angle is varied during the axial movement of the sleeve by means of a drive lug on the drive shaft having a cam track therein connected in rotary driving relation to cam follower means on the wobble plate. The cam track opposite ends define respectively, maximum and minimum stroke lengths for each of the pistons whereby under controlled pressure conditions the force system results in the pistons tending to go to their full stroke positions.

5 Claims, 9 Drawing Figures

VARIABLE STROKE COMPRESSOR

This invention relates to an improved variable displacement wobble plate refrigerant compressor and more particularly to an improved variable displacement compressor for an automotive air conditioning system.

There has been an increased need in automotive air conditioning systems for an improved compressor which is adapted to be directly driven by the car engine at all times and in which the output of the compressor is modulated in response to refrigeration requirements, thereby contributing to reduced weight and improved fuel consumption for the automobile. One example of such a compressor is disclosed in U.S. Pat. No. 3,062,020 issued Nov. 6, 1962 to J. H. Heidorn, entitled "Refrigerating Apparatus with Compressor Output Modulating Means", and assigned to the assignee of the present application. The instant invention concerns an improvement over the wobble plate compressor of the Heidorn patent which contributes greatly to the practicability of its manufacture by a design in which the various machining operations are simplified and wherein the sealing of the unit provides a relaxing of tolerances otherwise necessary in the prior art as exemplified by the aforementioned Heidorn patent.

It is an object of the present invention to provide an improved automobile air conditioning wobble plate compressor which allows the stroke of its pistons to be varied as required to match the system pumping capacity exactly to the system requirements wherein the wobble plate journal is constrained by the plate varying mechanism such that upon a change of volume displacement of the compressor the pistons always attain a constant top-dead-center clearance while infinitely varying the stroke of the piston travel, assuring maximum pumping efficiency at all displacements.

It is another object of the present invention to provide an improved lubrication arrangement for a modulating variable displacement wobble plate compressor wherein the drive shaft has longitudinally extending front and rear shaft passage portions, the shaft front portion in communication with a crossover portion disposed radially outboard of the wobble plate whereby a controlled flow of lubricant is carried from an oil pump to a forwardly positioned expansible chamber for varying the angle of the wobble plate, wherein a sleeve member surrounds the drive shaft in sealing relation therewith with a hollow connecting pin providing a pivotal connection between the sleeve and wobble plate, and wherein the shaft rear portion is in communication with the hollow pin for supplying lubricant to a plane bearing surface between the wobble plate and its piston rod socket plate through the hollow of the pivot pin.

It is another object of the present invention to provide an improved variable displacement wobble plate compressor having a plurality of cylinder bores with reciprocating pistons therein arranged axially with the axis of its drive shaft, a sleeve circumscribing the drive shaft in sealing relation therewith for connection with an expansible chamber power unit with the wobble plate being connected to the sleeve for pivotal movement relative thereto during axial movement of the sleeve, whereby a radial projecting drive lug on the shaft has a cam track for receiving a follower in the wobble plate, with the follower axially movable with respect to the drive lug in response to the movement of the sleeve by controlled pressure in the expansible chamber, the wobble plate being operated in response to rotation of the shaft and drivingly connected to the pistons in a manner to receive the piston force on the wobble plate when refrigerant is being pumped, with the result that the cam follower is always radially more remote from the axis of the shaft than the piston force on the wobble plate, such that the wobble plate tends to move to an increased angular position causing the compressor pistons to go to their maximum stroke length allowing the pistons to maximize the amount of refrigerant pumped so that escaped lubricant will be returned to the compressor from an air conditioning system.

It is another object of the present invention to provide an improved variable displacement wobble plate compressor having a plurality of cylinder bores arranged axially with the axis of its drive shaft, pistons arranged to reciprocate in the bores, a radial lug on the drive shaft in rotary driving relation to the wobble plate, a sleeve surrounding the drive shaft in sealing relation therewith for connection with an expansible chamber power unit, and a wobble plate being connected by pivot pins to the sleeve for pivotal movement relative thereto during axial movement of the sleeve, wherein a longitudinal slot in the sleeve receives the radial drive lug with the slot being dimensioned to provide longitudinal clearance with the lug throughout the axial movement of the sleeve, whereby the lug is in direct rotary driving relation with the wobble plate and thereby freeing the wobble plate pivot pins from receiving any torque load from the drive shaft.

Further objects and advantages of the present invention will be apparent from the following description, reference being had to the accompanying drawings wherein a preferred embodiment of the present invention is clearly shown.

Figure 1:
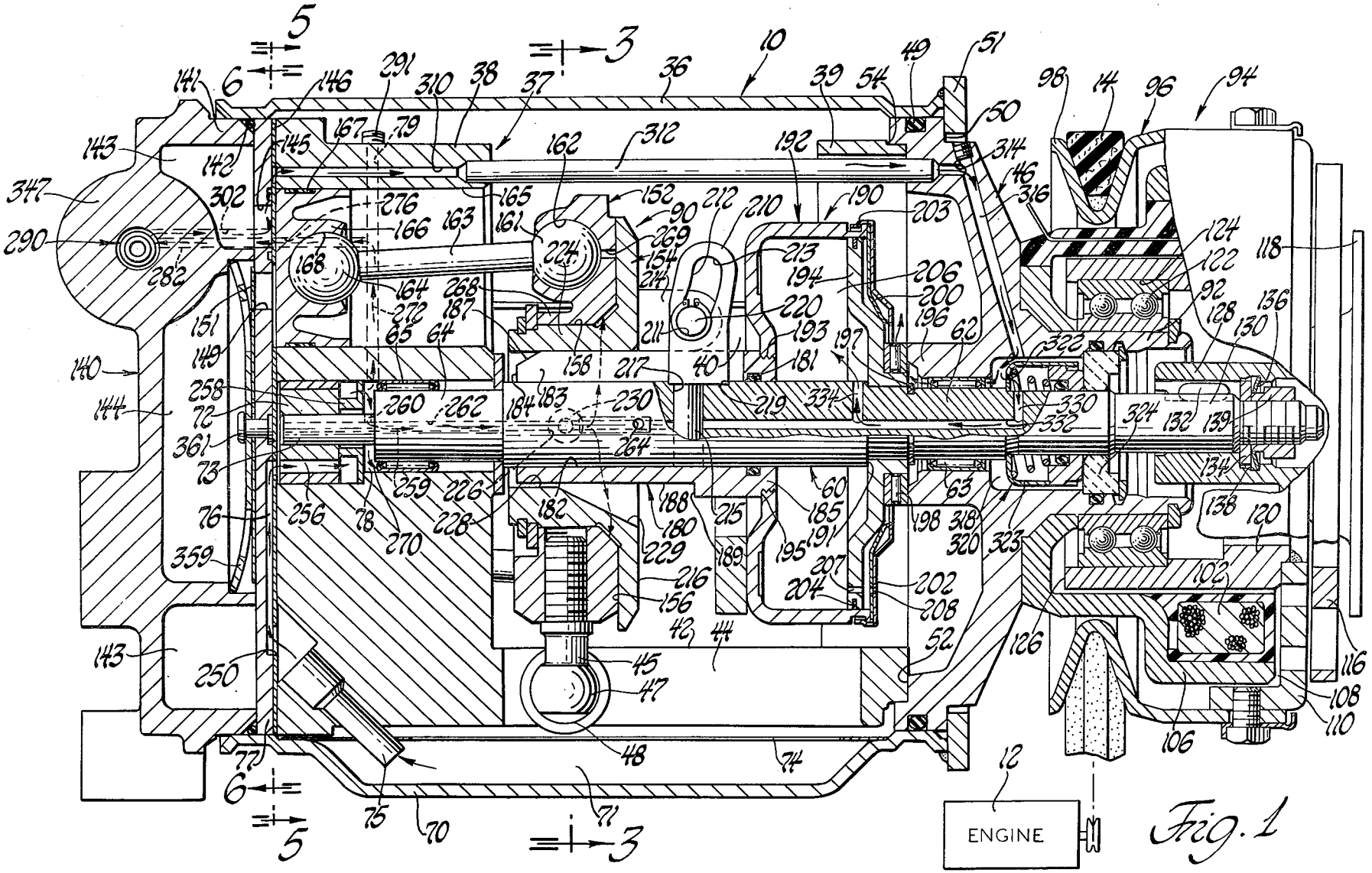
FIG. 1 is a vertical sectional view showing a preferred form of the invention.

Referring now to the drawings wherein preferred embodiments of the invention have been disclosed, reference numeral 10 in FIG. 1 designates a variable displacement axial compressor which is adapted to be driven by the main car engine 12 through suitable belt means 14. The mentioned Heidorn patent shows the compressor driven from the car motor by a belt such that is operates at widely varying speeds which are determined by the vehicle speed rather than by refrigeration requirements. On current auto air conditioning systems compressor capacity control is obtained by use of an electromagnetic clutch. In the clutch starting and stopping system to be described the compressor's principle of operation involves reducing the refrigerant pressure drop between the evaporator and the compressor by varying the compressor displacement to match the cooling requirement of the car. As a result, at moderate temperatures the compressor capacity is modulated to pump only the amount of refrigerant required to cool the car. Suction gas is delivered from the evaporator to the compressor at higher pressures and densities because, with the elimination of the suction throttling valve there is a reduction of line pressure drop. The fact that suction gas enters the compressor at a higher density together with the reduction of mechanical or friction losses achieves a reduction in compressor power requirements.

Figure 4:
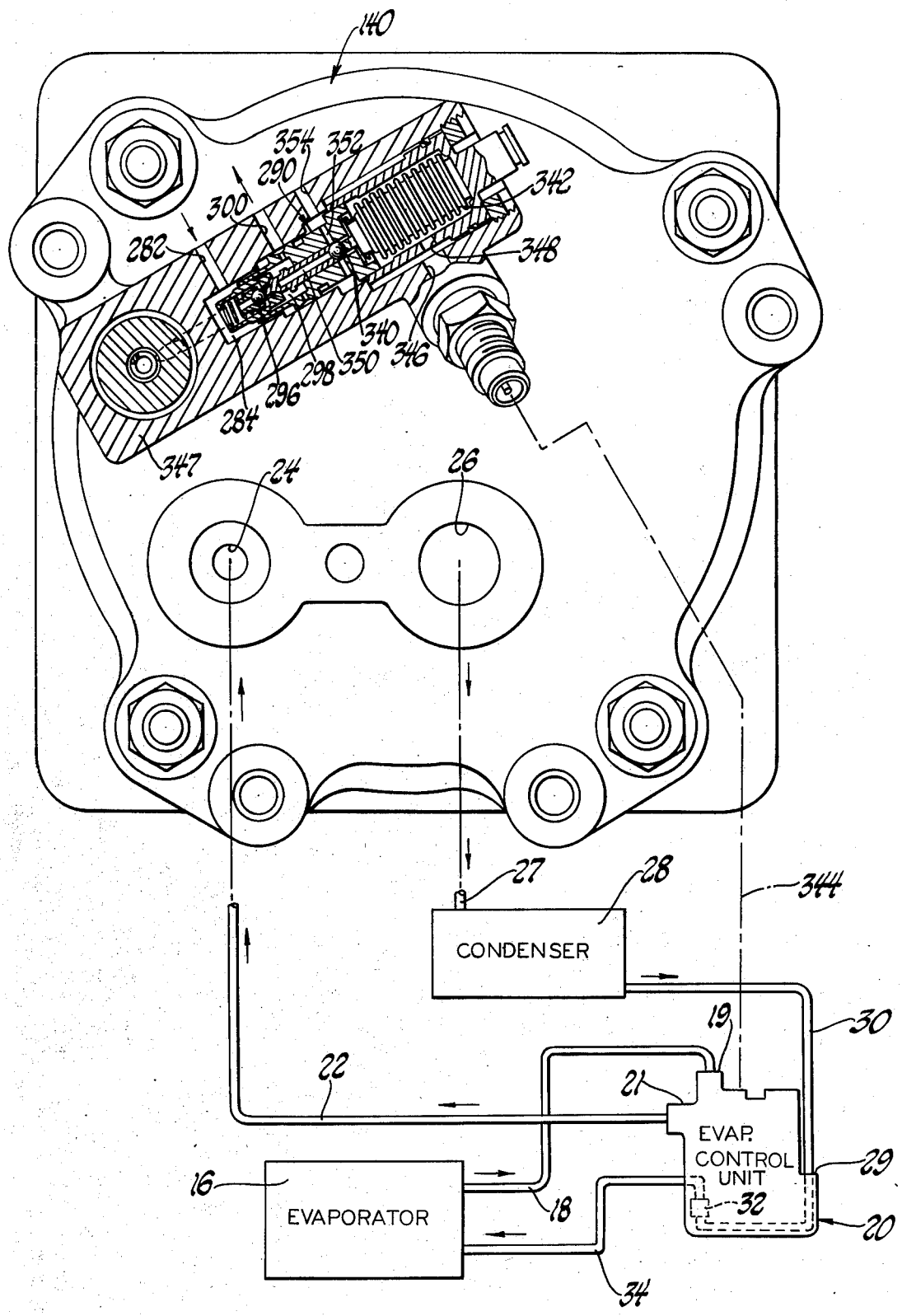
FIG. 4 is an end elevational view with parts broken away schematically showing the refrigeration system.

As shown schematically in FIG. 4, the refrigerating system includes the usual refrigerant evaporator 16 having an outlet line 18 leading to the one inlet 19 of a receiver 20 and exits at 21 into line 22 leading to the compressor inlet 24. The compressed refrigerant leaves the compressor 10 through an outlet 26 into line 27 connected to a conventional condenser 28. The condensed refrigerant returns to a second inlet 29 of the receiver 20 by line 30 from whence the liquid refrigerant flows through a suitable pressure reducing means, which for the purposes of illustration has been shown as an expansion valve 32 in the receiver, and thereafter returns to the evaporator by line 34. The compressor 10 and the condenser 28 are preferably located in the engine compartment of the car while the evaporator 16 is arranged in an enclosure so as to cool air for the passenger compartment of the car in the usual manner.

The compressor preferably includes an outer housing shell 36, which may be formed from sheet metal or as a casting, being substantially cylindrical in shape. The housing shell encircles an inner cylinder case 37, preferably formed as a single aluminum casting comprising a rear cylinder block 38 and a front cylinder collar 39 interconnected by a pair of longitudinally extending stringers 40 and 41 and a guide stringer 42 (FIGS. 2 and 3) having a longitudinal slot 44 formed therein for the reception of a guide pin or rod 45 and ball 47 in suitable contoured guide shoes 48 of a shoe assembly for a purpose which will be discussed below. The front head 46, preferably formed as a separate member such as a cast aluminum member, is disposed in the right hand or front end of the housing shell and sealed thereto by O-ring seal 49 to close same. An outer peripheral notch 50 is formed in the front head for flush engagement of ring 51, which ring is welded to the front end of the housing 36. The front head 46 has an inner annular counterbore 52 which telescopingly engages a notched surface 54 of the front head in nested fashion for alignment of the bearing bores for reception of compressor main drive shaft 60. The compressor main drive shaft 60 has its forward intermediate end 62 rotatably mounted or journaled on front needle bearings 63 in the compressor front head 46 and its rearward reduced end 64 journaled on rearward needle bearing 65 in the cylinder case 37.

Figure 5:
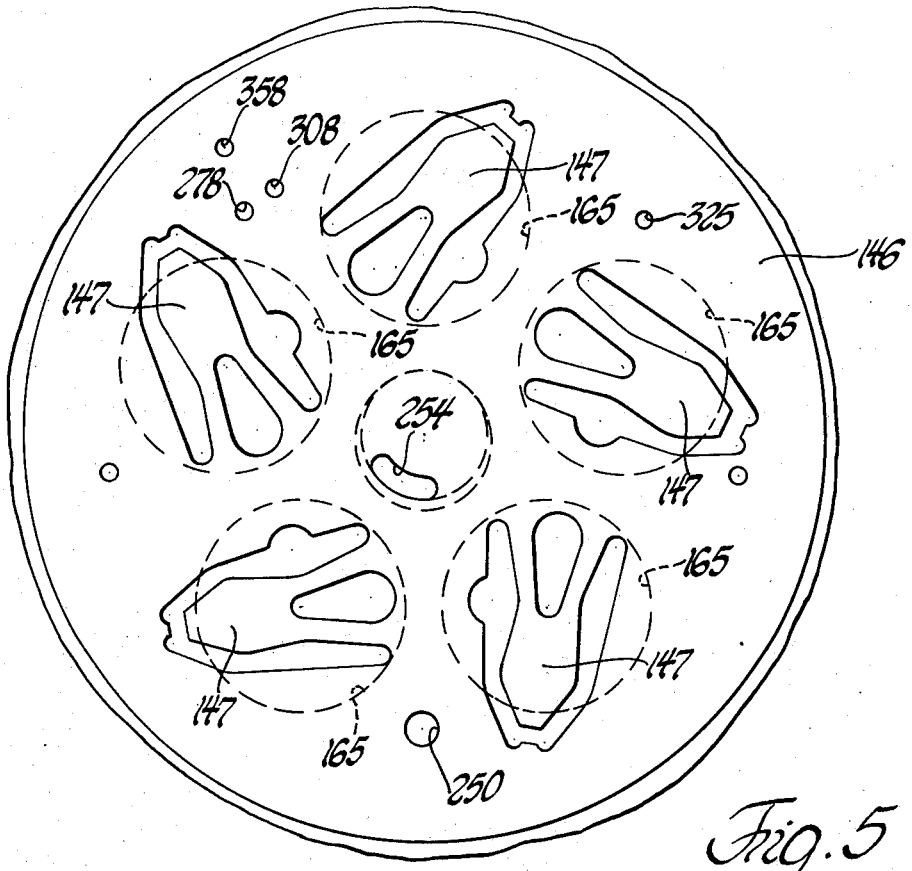
FIG. 5 is a vertical sectional view taken on the line 5—5 of FIG. 1.
Figure 6:
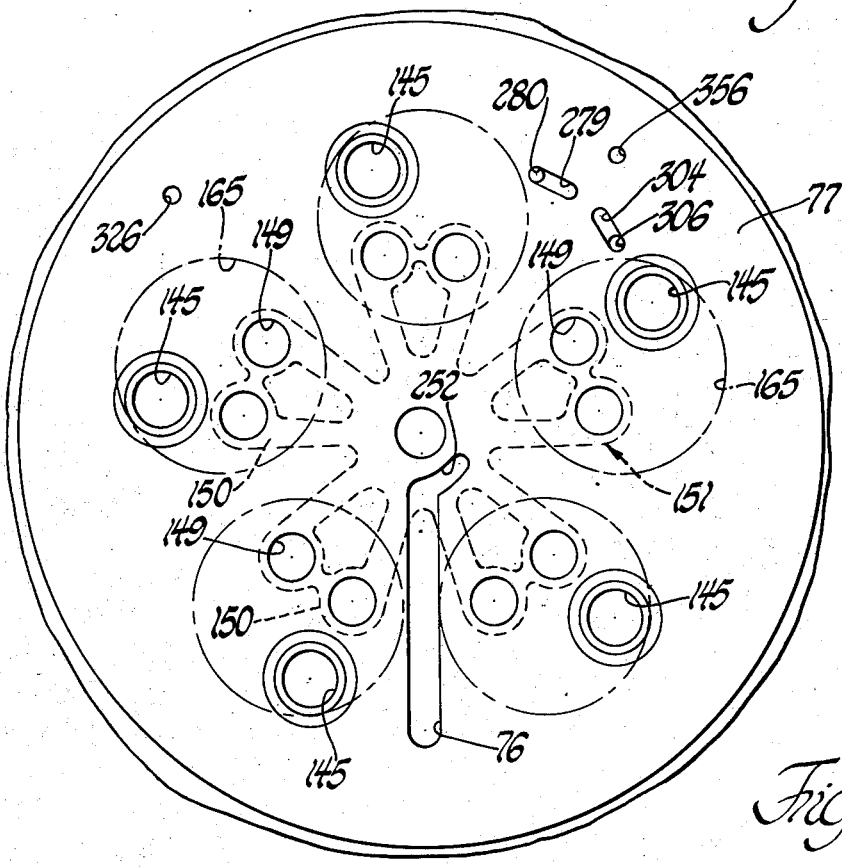
FIG. 6 is a vertical sectional view taken on the line 6—6 of FIG. 1.

The housing shell 36 completely encloses the compressor mechanism and is provided with a distended bulged portion 70 forming an oil sump 71 beneath baffle 74 which collects an oil and refrigerant mixture for circulation through the compressor lubricating its associated bearings and seals. A lubricating oil gear pump assembly 72, driven by a D-shaped quill 73 shown as a reduced extension of the shaft rearward end 64, serves to withdraw oil and refrigerant solution from the sump 71 through an oil pick-up tube or conduit 75 which communicates via aperture 250 in reed valve discs (FIG. 5) with an aligned passage slot 76 (FIG. 6) in the inner face of valve plate 77 connecting with the inlet side of gear pump 72. Pump 72 discharges the pressurized mixture into chamber 78 from which it flows upwardly through a passage 79 in the cylinder block 38, shown in dashed lines in FIG. 1, to an oil pressure relief valve of the compressor hydraulic control system to be discussed later in the specification.

A wobble plate drive mechanism, generally designated by the reference numeral 90, serves to reciprocate a plurality of pistons, to be described, in response to the rotation of the main drive shaft 60. The shaft forward end extends through front head hollow spindle or fixed tubular extension 92 for mounting a drive mechanism 94 thereon including an electrically engaged clutch shown generally at 96. The clutch includes a driving pulley assembly 98 that is selectively engaged with the shaft 60 when an annular electromagnetic coil 102 is energized.

As explained in the U.S. Pat. No. 3,876,048 to Briar, assigned to the same assignee as the present application, the electromagnetic clutch 96 is engaged by the energization of the electromagnetic coil 102 which causes the magnetic flux to traverse a path through the adjacent coil housing 106 formed of paramagnetic material, i.e., from the coil 102 to the adjacent outer wall of the coil housing 106, and then across the gap 108 to the clutch rotor 110, thereafter traversing a serpentine path through the clutch field resulting from the spaced relationship of the alternately located cooperating arcuate slots (not shown) thereby closing the gap 108, to drive the armature plate 116 and drive the plate 118 along with the rotor 110 and the pulley assembly 98. The flux completes its path of travel back to the coil 102 via sleeve member 120.

A bearing 122 is mounted in a counterbore 124 formed within the outer end face 126 of the sleeve member 120. A drive hub 128, which is mounted upon a reduced end portion 130 of the shaft 60, is keyed thereto by a suitable lug 132 and is retained thereon by a washer 134 and a lock-washer 136, the washer 134 and the lock-washer 136 being confined in a stepped annular groove 138 formed within the drive hub 128 by a nut 139 threadedly mounted on the shaft-end 130.

The valve plate assembly 77 is held against the end of the cylinder block 38 by means of the cylinder rear head assembly 140 having a cylindrical portion 141 which telescopes within the aft end of the housing 36 and is sealed thereto by O-ring 142 and sealed to the housing. The cylinder head assembly includes an outer suction or inlet chamber 143 and a center discharge chamber 144. As shown in FIG. 1, each compression chamber or bore 165 communicates with the suction chamber 143 through an inlet port such as the port 145 shown in FIG. 6. An inlet reed valve disc 146 (FIG. 5), having inlet reeds 147, controls the flow of refrigerant through the suction inlet ports 145 in accordance with standard practice. The compressed refrigerant leaves each compression bore 165 through a discharge port 149 while a reed valve 150, in a discharge reed valve disc 151, at each discharge port 149 is provided in accordance with standard practice.

Figure 2:
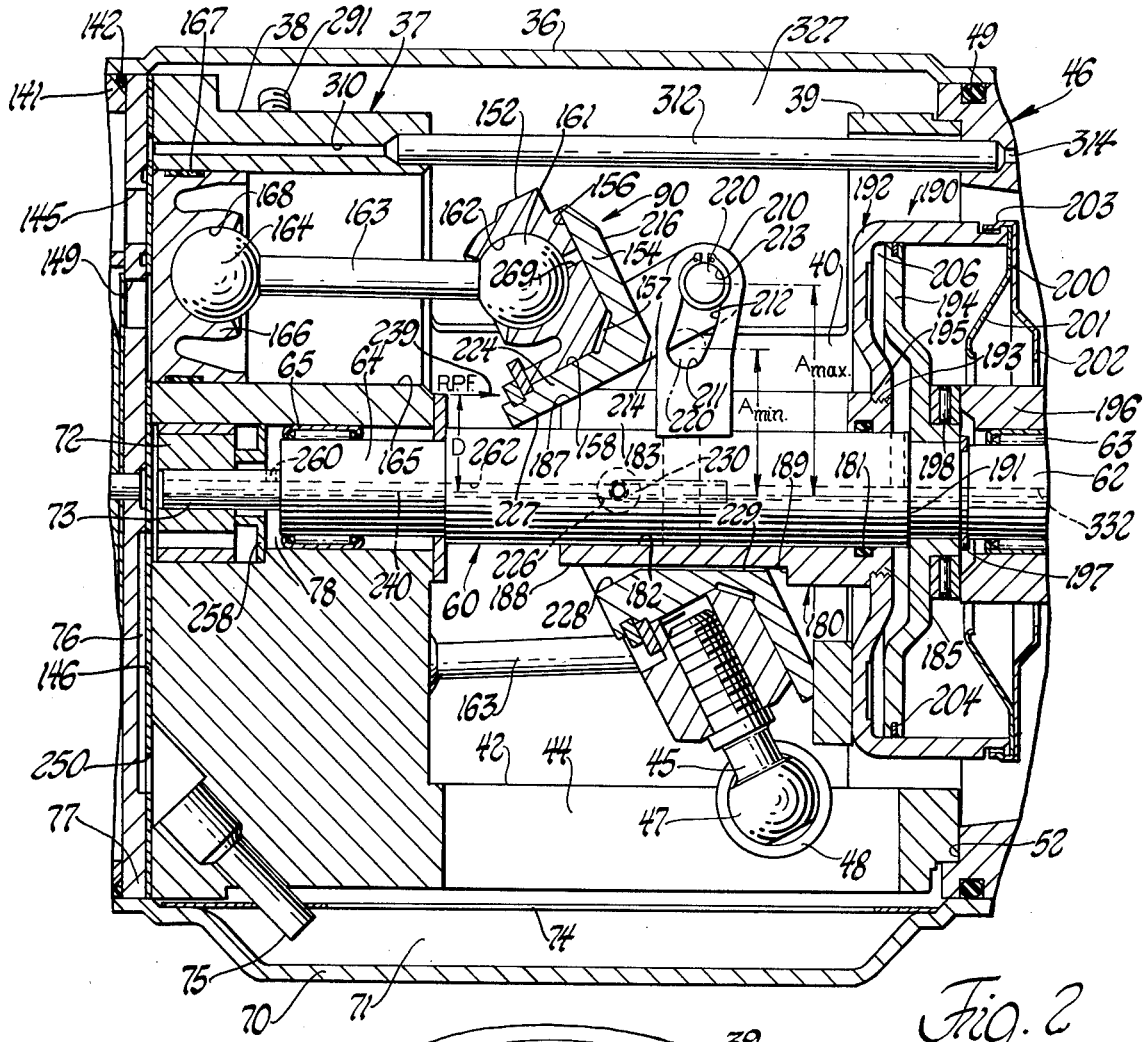
FIG. 2 is a fragmentary vertical sectional view showing the arrangement of parts when the compressor operates at full capacity.

For purposes of illustrating this invention, a variable displacement five cylinder axial compressor 10 will be described whereas it will be understood that the number of cylinders may be varied without departing from the spirit and scope of the invention. The wobble plate drive mechanism assembly 90 includes a socket plate 152 and a journal element or wobble plate 154. The wobble plate 154 and socket plate 152 define a plane bearing surface 156 and an outer cylindrical journal surface 158 with the wobble plate rotating in unison with the shaft 60. The wobble plate 154 has five sockets, one of the sockets being shown at 162, for receiving the spherical ends 161 of five connecting rods, like the connecting rod 163, as seen in FIGS. 1 and 2. The free ends of each of the connecting rods 163 are provided with spherical portions 164 as shown. Cylinder block 38 has a plurality of axial cylinder bores 165, there being five in the preferred embodiment, in which pistons 166 are sealed by rings 167 which in the disclosed form are Teflon washers as described in U.S. Pat. No. 3,885,460, assigned to the assignee of the present application. Pistons 166, having socket-like formations 168, engage the one end of each connecting rod 163. The pistons 166 operate within their associated compression chambers or bores 165 whereby upon rotation of the drive shaft 60 and the wobble plate 154 will cause reciprocation of the pistons 166 within their bores 165.

Figure 3:
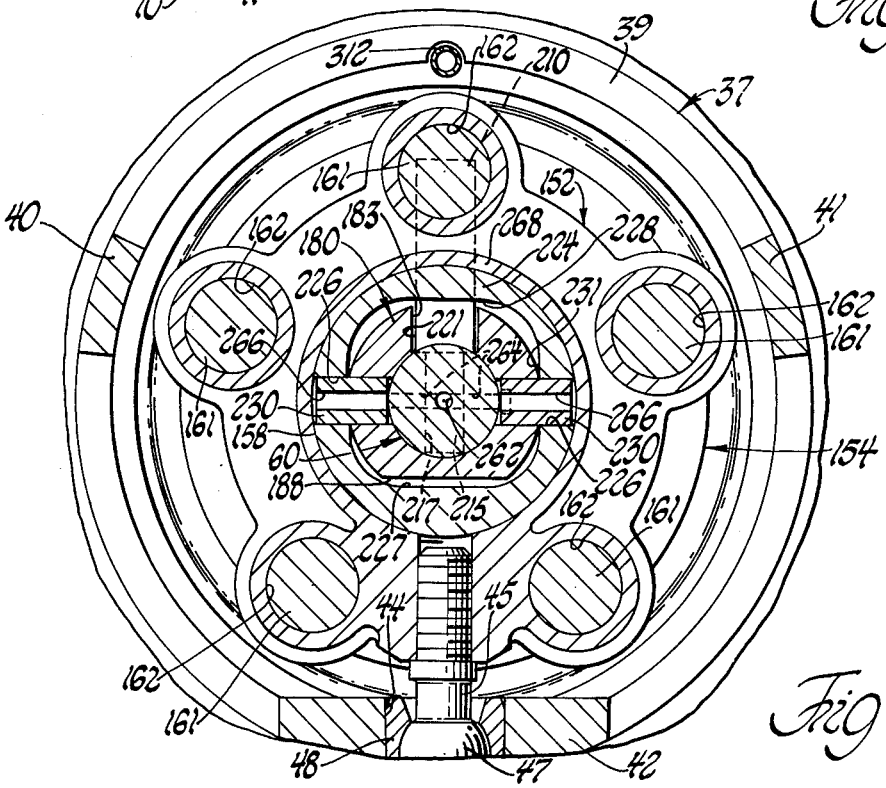
FIG. 3 is a fragmentary sectional view taken substantially on line 3—3 of FIG. 1.

As seen in FIGS. 1–3, the socket plate 152 is prevented from rotating by means of the guide shoe 48 which slides within its longitudinal slot 44 provided in one wall of the cylinder case 37. As stated above the shoe assembly consists of the spherical ball element 47 having a socket formation which engages one end of the guide pin rod 45 the other end of which is fixedly received in a bore within the socket plate 152.

Figures 7, 8:
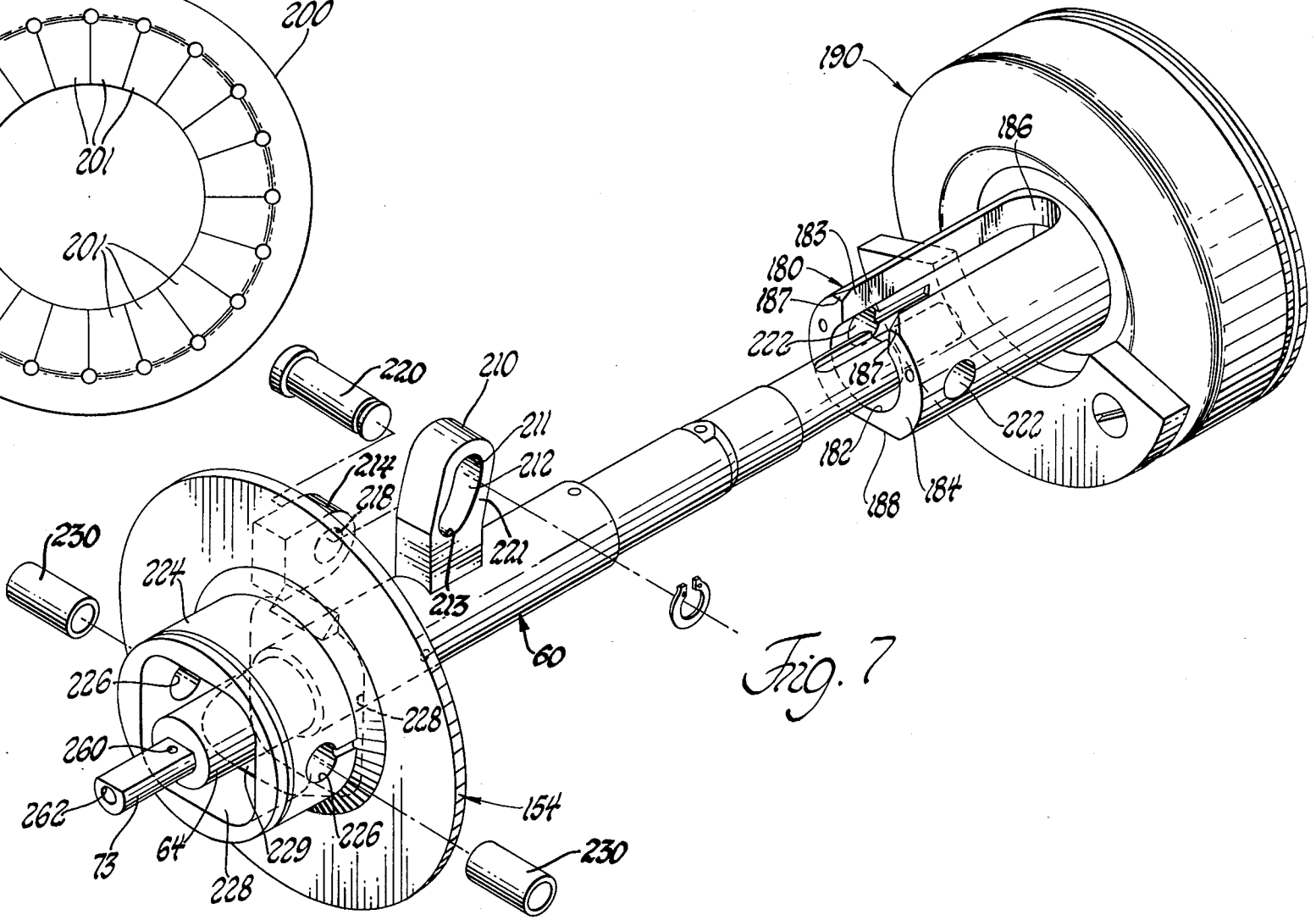
FIG. 7 is a perspective exploded view of the shaft and sleeve assembly.
FIG. 8 is an enlarged elevational view of the control cylinder spring member.

The shaft 60 has a generally cylindrical sleeve member 180 surrounding or circumscribing the shaft in hydraulic sealing relation therewith by means of O-ring seal 181 located in a groove in the inner surface 182 of the sleeve as seen in FIG. 7. The sleeve member 180 has formed therein a longitudinal slot 183 extending from the sleeve inner or rearward face 184 substantially the full length of the sleeve and terminates in a U-shaped radiused portion 186 adjacent an axial movable portion of an expansible chamber actuator to be described. The sleeve face 184 includes a chamfered front edge 187. It will be noted in FIGS. 1 and 7 that the sleeve member 180 has a flat face portion 188 located in 180° opposed relation to the slot 182 and which face terminates in a notched shoulder 189 to provide clearance with the journal 154.

As seen in FIG. 1, sleeve reciprocating actuator or modulating means are provided at 190 including a cup-shaped forwardly opening element or modulating cylinder 192, which is shown secured on the forward reduced diameter end 185 of the sleeve 180 for rotation therewith by suitable means such as threads 193. The actuator 190 further includes an axially stationary internal disc-shaped modulating piston member 194. In the disclosed embodiment the internal modulating piston member 194 abuts shaft shoulder 191 and is fixed on shaft portion 62 for rotation therewith by means of a press fit together with a snap ring 197, while the inner end face of integral front head hub 196 has a thrust needle bearing 198 positioned therebetween.

An important feature of applicants' improved design is provided by sleeve squaring shoulder and stop 195 formed by the reduced end portion 185. The shoulder and stop 195 together with the relatively long axial extent of the sleeve 180 provides a ready means to insure a sufficiently stable interrelationship between the sleeve 180 and element 192 to resist binding of the slidable sleeve unit 180 and element 192 with the drive shaft 60.

Resilient return means in the form of a truncated cone return spring member 200, having a plurality of radiating leaf spring fingers 201, as seen in FIG. 8, is positioned concentrically within the modulating cylindrical cup 192 for movement therewith. The spring 200 is retained by virtue of its outer periphery being sandwiched between the modulating cylinder peripheral edge and cover 202. The spring member 200 is operative upon the modulating cylinder 192 being moved axially to the left from its position in FIG. 2 to its position in FIG. 1 to be compressed between the front face of the internal fixed plate piston member 194 and the cover member 202, fixed on the open end of the modulating cylinder 192 and snapped into place by peripheral flanges 203. Thus, the spring member 200 functions to move the wobble plate mechanism 90 off its dead center or zero stroke position and starts pumping by biasing the cup-shaped element 192 toward its full stroke position shown in FIG. 2. It will be noted that suitable hydraulic sealing means are provided between disc member 194 and the inner annular surface of element 192 which in the form of FIGS. 1–8 is shown as a split ring seal 204.

The modulating piston member 194 cooperates with the cylinder 192 to form an expansible chamber 206 the size of which is varied by supplying lubricant under pressure into the chamber 206. At high lubricant pressures, the cup-shaped element 192 and sleeve 180 will be shifted axially to the left, as viewed in FIG. 1. The chamber 206 may be unloaded when cylinder 192 is moved to the right by suitable means such as a plurality of bleed holes one of which is shown at 207 in modulating piston member 194 and 208 in cover 202.

The shaft 60 carries a drive lug portion 210, extending in a transverse or normal direction to the drive shaft axis. The lug 210 has formed therein a guide slot or cam track 212 which extends radially along the axis of the drive shaft. The journal element 154 carries an ear-like member 214 projecting normal to the journal forward face 216 and has a through bore 218 (FIG. 7) for receiving cam follower means in the form of a cross pin driving member 220. As seen in FIG. 7 the ear 214 is offset from but parallel to a plane common to drive shaft principal axis and the sleeve slot 182 an amount which allows the opening 218 and bottom radius of the cam track 212 to align themselves with the journal element in its FIG. 1 position, i.e. the wobble plate journal 154 disposed in a plane perpendicular to the axis of rotation of the shaft 60. It will be noted that in this FIG. 1 position the wobble plate assembly 90 renders the compressor ineffective to compress refrigerant gas, because the pin 220 is located at the radially inward limit of cam track 212 defining minimum or zero stroke length for each of the pistons. FIG. 2 shows the arrangement of the wobble plate mechanism 90 for maximum compressor capacity wherein the pin 220 is positioned at the radially outer end of cam track 212 defining the maximum stroke lengths for each of the pistons.

It will be noted that the drive lug 210 includes an integral dowel portion 215 of circular cross section which is received in a transverse bore 217 in drive shaft 60 and suitably secured therein as by hot-upsetting the end of dowel 215 or cross pinning. As seen in FIG. 1 the shaft 60 is machined with a countersunk transverse slot 219 which receives the transverse end faces of the rectangular sectioned lug 210 to properly align and lock the lug 210 against any rotational movement of its dowel 215 in shaft bore 217.

With reference to FIG. 3 the clearance slot 183 is shown having a width relative to the width of lug 210 whereby the lug remains out of contact with the slot 183. By virtue of the lug 210 being free of contact with the sides of sleeve slot 183 the slot can be formed without regard to tolerance considerations which could be the case if the slot were designed with its side faces in sliding contact with the lug 210 during the axial travel of the sleeve 180.

It will be appreciated that another and more important result of having an oversize clearance slot 183 in the sleeve is that torque is transmitted directly from the drive shaft 60 to the wobble plate mechanism through the lug 210. This avoids or obviates having torque load transfer between the shaft 60 and the wobble plate at the pivotal connection provided by pivot or cross pins 230 about which the wobble plate mechanism pivots. It will be noted that the sleeve 180 is held in its "floating" radial alignment by pins 230. Applicants' unique sleeve 180 further eliminates difficult machining operations required by the rectangular sectioned drive shaft with opposed slotted square channels shown in the mentioned Heidorn patent. Thus, applicants' drive shaft 60, by contrast, can be readily and inexpensively formed from conventional steel bar stock.

It will be seen in FIG. 7 that the transverse axis of bores 222 in sleeve 180 intersect the rotational axis of shaft 60. Thus, the hub 224 of the journal plate, formed with cross bores 226, receives the sleeve 180 in the hub's generally rectangular sectioned axial opening defined in part by upper and lower faces 227 and 228. The chamfered surface 229, which provides a clearance with sleeve surface 188 in the full stroke position can be a cast-in-place surface for use as is. This design allows the four surfaces of the rectangular opening, including parallel side surfaces 231, to be formed by a single broaching operation. Upon assembly the journal cross bores 226 are aligned with the sleeve bores 222 for the reception of the hollow transverse pivot or trunnion pins 230 (FIG. 3) permitting the wobble plate assembly 90 to pivot thereabout.

It will be seen that the above-described arrangement of parts have opposite radiused ends 211 and 213 of the cam track 212 which provide one method to define respectively, the maximum and minimum stroke lengths for each of the pistons 166 in a manner to constrain the wobble plate assembly 90 providing essentially constant top-dead-center (TDC) positions for each of the pistons. Cam follower means in the form of the pin follower 220 interconnects the wobble plate mechanism 90 and the drive shaft 60 and is movable radially with respect to the lug 210 and the wobble plate mechanism 90 in response to the movement of the sleeve 180, whereby the angle of the wobble plate mechanism is varied with respect to the drive shaft 60 to infinitely vary the stroke lengths of the pistons 166 and thus the output of the compressor.

The lubricating arrangement for applicants' compressor operates as follows. Arrows in FIG. 1 show that oil is drawn up from the compressor sump area 71 through the pick-up tube 75 and through an aperture 250 in the suction inlet reed disc 146 and thenbe into lubricant passage means in the form of a generally vertical slot or groove 76 (FIG. 6) formed in the inner face of the valve plate 77. The groove 76 has an upper arcuate portion 252 which communicates with a second kidney-shaped aperture 254 in valve disc 146 arranged directly over the intake area 256 of the gear pump 72. The oil gear pump assembly 72 pressurizes the oil as the pump is rotated on the end of the compressor shaft.

An internal flow path for the pump lubrication system is established by oil under pressure being discharged through a hole (not shown) in the oil pump cover 258 into a region 78 enclosed by the cylinder case 37, the shaft 60, and the rear needle bearing 65. From region 78 the oil may take any one of three flow paths as indicated by arrows in FIG. 1. The first path, indicated by dashed arrows 259, involves flow through a radial bore 260 and an axial bore 262 in shaft 60 for travel forwardly to a pair of transverse bores 264 (FIG. 3) in shaft 60 aligned with wobble plate pin bores 266 for flow between the journal hub 224 and the socket plate hub 268 to lubricate the journal bearing surfaces 156 and 158. It will be noted in FIG. 1 that socket plate bores 269 may be provided to communicate with the journal bearing surface to allow oil to lubricate the spherical portions 161 of the connecting rods 163.

A second flow path, indicated by short arrows 270 in FIG. 1, is from the region 78 through the rear needle bearing 65 for lubrication thereof.

A third flow path, indicated by dashed arrows 272 in FIG. 1, involves flow from region 78 through cylinder block radial bore 79 and thence rearwardly via cylinder block axial bore 276, valve disc hole 278 (FIG. 5), valve plate slot 279 and hole 280 (FIG. 6), rear head bore 282 for entrance into the blind end region 284 of hydraulic control valve generally indicated at 290 in FIG. 4. The valve 290 functions to control the amount of piston stroke. It will be noted in FIG. 1 that in the third path there is located a pressure relief valve, the threaded stem of which is shown at 291, with the relief valve operative to limit the magnitude of the oil pressure.

As seen in FIG. 4, upon oil reaching the blind bore 284 the oil may flow through the valve 290 past the lower ball valve member 296 and thence into region 298 for exiting via exit bore 300. From exit bore 300 the oil returns to the compressor via rear head return bore 302, valve plate slot 304 and hole 306 (FIG. 6), valve disc hole 308 (FIG. 5), and cylinder block axial return bore 310 into crossover tube 312. The crossover tube 312 exits into aligned axial bore 314 in front head 46 where bore 314 communicates with front head radial bore 316 for flow into the cavity 318 which receives the shaft front seal assembly 320. The seal assembly is described in detail in the mentioned Briar U.S. Pat. No. 3,876,048.

From cavity 318 the oil flows forwardly through aperture 322 in seal cup 323 to lubricate the shaft seal ceramic disc 324. Another flow path for the oil, as seen by the solid arrows in FIG. 1, is through the shaft front needle bearing 63 and thrust bearing 198 for lubrication thereof.

Still another flow path from cavity 318 involves entrance into shaft radial front bore 330 and thence into front axial bore 332, which is closed off from the rear axial bore 262 by dowel 215. From bore 332 oil flows outward from shaft front radial exit bore 334 for passage into the expansible chamber 206 of the hydraulic cylinder for hydraulic movement of modulating cylinder 192 for control of the compressor stroke.

It will be noted that applicants' lubrication and hydraulic control system of FIGS. 1 and 4 is such that small controlled oil leakages will occur past the hydraulic piston 192 into a cup-like reservoir which reservoir will retain a measured amount of oil by centrifugal action of the order of three ounces. Thus, a continuous flow of lubricant will flow through the crossover tube 312 to replenish the hydraulic cylinder 190 whenever the piston stroke is less than full or one hundred percent. Further, it will be noted that oil enters the lubricant crankcase 71 by means of piston blow-by during the compression stroke of the pistons 166 as discussed in U.S. Pat. No. 3,930,758 to Park and exits through the crankcase to suction inlet chamber 143 via a crankcase to suction equalizer passage consisting of aligned holes 325 in the inlet reed valve disc 146 (FIG. 5) and hole 326 in the valve plate 77 (FIG. 6) which are aligned with an axial passage in block 38 (not shown) extending from suction inlet chamber 143 to the swash plate chamber 327. The piston blow-by entering oil flow path together with the oil exit path of the block passage and holes 325 and 326 define passage means in unavoidable limited communication with the refrigerant of the air conditioning system. The result is that upon the gear pump 72 pumping lubricant in the compressor housing or crankcase to the chamber 206 in a controlled amount to provide the controlled pressure for actuating the modulating cylinder 192, lubricant occasionally escapes the compressor housing and becomes commingled with the refrigerant to the point where the lubricant pumping means 72 has insufficient lubricant in the housing to provide the necessary controlled pressure.

Upon full piston stroke being required, one of the following conditions will occur. First, the crossover flow of oil through tube 312 will be limited below the rate required to sustain any reduction in stroke length by the pistons. Second, the front bearings will receive adequate lubrication solely by the splashing of oil by the wobble plate mechanism. In the event, however, that the hydraulic control valve 290 signals for a reduction in the piston stroke, with the condition of insufficient oil in the crankcase 71 to fill the hydraulic cylinder chamber 206, it is inherent in applicants' arrangement for the compressor to seek to return to its full piston stroke mode of FIG. 2. The reason is that in the force system, to be described, the resultant piston force (R.P.F.), shown by arrow 239, acts on the wobble plate 154 in such a manner that its point of application at any given time is always radially inboard of the cam contact line between the follower pin 220 and the track 212. That is, the horizontal component of the force of the pin 220 on cam track 212 is always radially more remote from the axis 240 of the drive shaft than the predetermined point of application of the resultant piston force 239 on the wobble plate. Thus, the follower pin 220 is movable radially outward with respect to the axis 240 of the drive shaft in response to a pivotal movement of the wobble plate caused to happen by the resultant piston force 239 in the absence of controlled pressure whereby the angle of the wobble plate is progressively varied with respect to the axis of the shaft toward providing maximum stroke length for the pistons to maximize the amount of refrigerant pumped. The result is that the mass flow rate of the system, with the mass comprising liquid refrigerant, gas refrigerant and oil, is temporarily increased tending to return more oil to the crankcase 71 thereby allowing the mechanism to attain the required stroke thus satisfying the system requirements.

As seen in FIG. 4, the control valve 290 includes a second or upper ball valve 340 which along with lower ball valve 296 is controlled by the valve bellows 342 which senses evaporator pressure from the evaporator control unit 20 by means of line 344, liquid passage 346 in the rear head housing 347 and passage 348 in the valve housing. Thus, upon a decrease in evaporator pressure the bellows 342 will contract opening upper ball valve 340 allowing hydraulic fluid to return to the compressor crankcase by means of a flow through the valve longitudinal passage 350, valve housing radial passage 352, rear head housing passage 354, valve plate passage 356 and reed plate passage 358 for return to the crankcase or sump 71. It will be noted in FIG. 1 that the extent of opening of the reed valve 176 is limited by a rigid back-up plate member 359 suitably secured to the valve plate 77 as by rivet 361.

Figure 9:
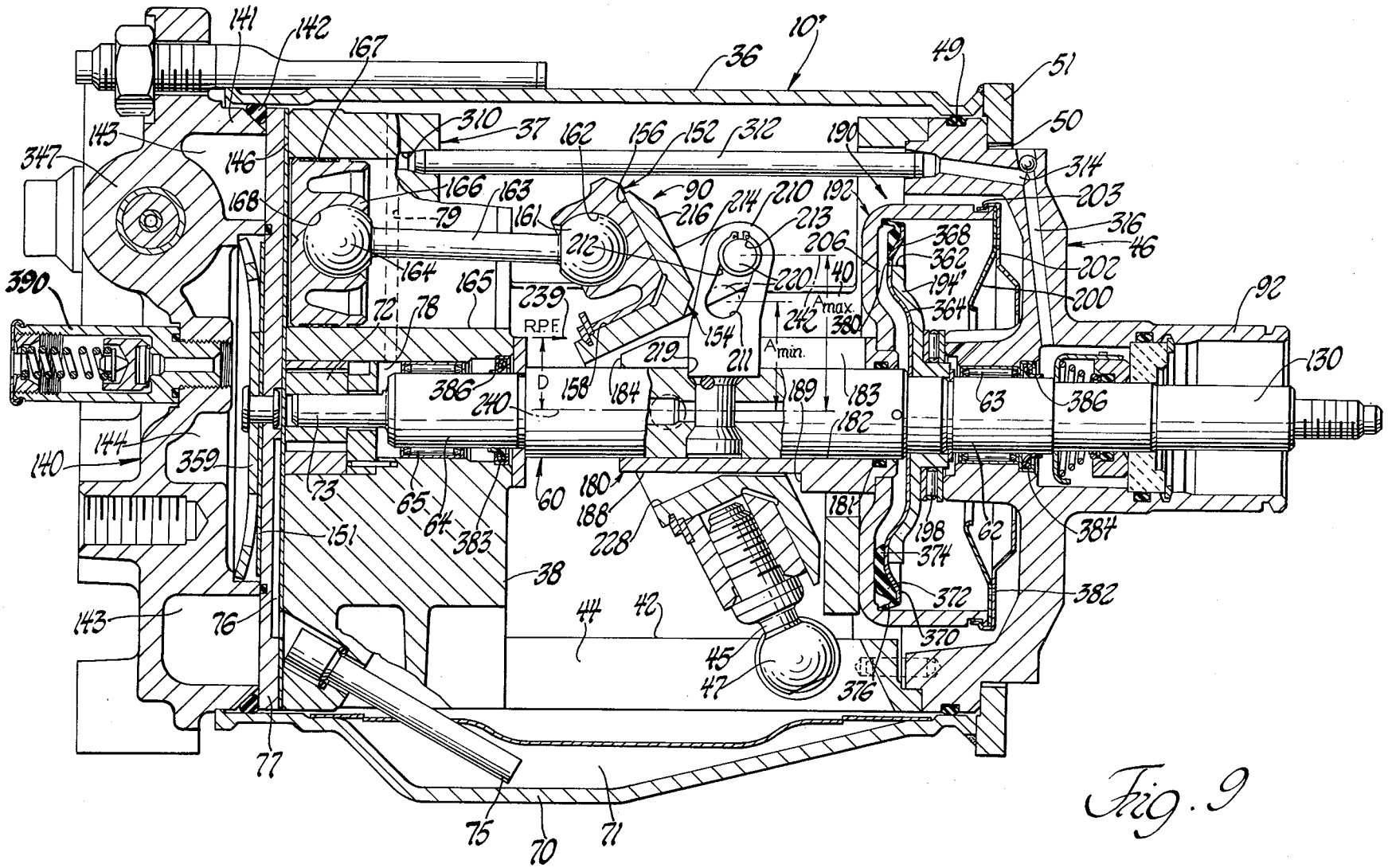
FIG. 9 is a vertical sectional view showing a modified form of the compressor.

With reference to FIG. 9, a modified form of applicants' compressor is disclosed. The same reference numerals have been used to designate corresponding elements of the compressor in FIGS. 1–8 and unless otherwise indicated by primed numbers the elements shown in FIG. 9 function in the same manner as the corresponding elements shown in FIGS. 1–8.

The compressor of FIG. 9 provides a substantially "leak-free" circuit for the hydraulic control circuit except for intentional controlled leakages through a predetermined axial oil bleed-hole arrangement to be described. The advantage of the "leak-free" system is that it enables a uniform manufacturing test procedure to be established. That is, having oil unloaded from the expansion chamber 206 by designed bleed holes rather than leakage past imperfect clearance seals is essential for quality control during production.

To this end the compressor of FIG. 9 includes a novel lip seal arrangement for the fixed piston plate member 194' wherein the plate has a reduced diameter terminating in peripheral edge 362. A sheet metal disc 364 is suitably secured in conforming fashion to the inner face of plate 194' preferably by being trapped by thrust bearing 198. The disc 364 extends radially outwardly past edge 362 and is formed with an angled or forwardly and outwardly sloped portion 368 terminating in a radial flange 370 for receiving a resilient rim seal member 372 in flush relation with the disc. Portions of the rim seal 372 are thickened, as at 374 to define resilient stop portions for the axial travel of cylinder 192, if desired. An outer resilient annular lip 376 is integrally formed around the rim seal 372 to provide an effective sealing or wiping contact against the inner surface of the cylinder 192.

As the FIG. 9 compressor pressurized hydraulic fluid or lubricant is effectively sealed in expansible chamber 206, except for controlled exit means, which in the disclosed form comprise a single bleed hole 380 in modulating piston member 194' and disc 364 and a plurality of aligned bleed holes 382 in the spring 200 and cover 202. In the form shown the bleed hole 380 has a diameter of about 0.031 inches. In this way the unloading or outward flow of hydraulic fluid from chamber 206 is controlled upon the wobble plate mechanism moving toward its full stroke position.

The sealing arrangement of FIG. 9 further includes front and rear shaft seal assemblies 383 and 384 respectively, to insure the controlled flow of lubricant in the compressor. In the preferred form the seal assemblies 383 and 384 include Teflon rings 386 which are lubricated by the pressurized lubricant to insure long-life hydraulic lip seals.

As graphically illustrated in FIGS. 1 and 9, an important feature of applicants' invention is that in the compressor mechanism the resultant piston force (R.P.F.), indicated by the arrow 239, for practical purposes is always adjacent to the shaft center line 240 and below the center of the radially movable cam follower pin 220.

This condition holds true even though, of course, the point of application of the R.P.F. continually varies during each 72° of rotation of shaft 60, which is the angular travel required for each piston to attain its top-dead-center position. Computer simulated test results show that the radial distance "D" of the resultant piston force 239 varies from a maximum of 0.067 inches below the center line 240 to a maximum of 0.160 inches above the center line 240. Also, as the angle of the wobble plate increases due to the expansion of chamber 206, there is a tendency of the pin 220 center line, indicated at 242 in FIG. 9, to move a greater radial distance A from the shaft center line 240 to further increase the pumping effect of the compressor. As a result applicants' improved cam follower pin and cam slot arrangement develops an inherent tendency of the compressor to go to its full stroke position illustrated in FIGS. 2 and 9. This tendency progressively increases in absence of controlled pressure in chamber 206, i.e. with the wobble plate positioned at its maximum angle as shown in FIG. 2.

This is in counterdistinction to the radially stationary or fixed form of cam follower pin arrangement of the prior art Heidorn U.S. Pat. No. 3,062,020. Thus, applicants' cam follower pin 220 is free to move radially outwardly to a constantly increasing radius as the angle of the wobble plate journal 154 is progressively decreased with respect to the shaft axis 240 from its minimum 90° stroke position of FIG. 1 to its maximum or full stroke of FIGS. 2 and 9, which in the form shown is an angle of about 63° with the axis 240.

Increasing loads on the compressor with consequent increase in the pumping stroke of the pistons results in cam follower pin 220 seeking to move radially outward from the shaft axis 240 because the length of its moment arm "A" is steadily increasing. The center of pin 220 moves outwardly at a faster rate than the resultant piston force (R.P.F.), which is shown acting at some instantaneous location, by arrow 239, where "D" is the radial distance from the shaft center line 240 to its point of application on the wobble plate mechanism. The lever arm or minimum radial distance $A_{min.}$ is at least sufficient to remain above or outboard of any predetermined point of application of the resultant piston force, i.e. $A_{min.}$ is always greater than the moment arm D.

It will be noted that the compressor of FIG. 9 shows a conventional high pressure relief valve 390 threadably received in a bore in the cylinder rear head assembly 140 for communication with the discharge chamber 144.

While the embodiment of the present invention as herein disclosed constitutes a preferred form it is to be understood that other forms might be adopted.

We claim:

1. In a variable output compressor having a housing, a cylinder block disposed in said housing, a circular drive shaft having its one end journaled in one wall of said housing and its other end journaled in said cylinder block, said cylinder block having a plurality of cylinder bores formed therein substantially parallel to the axis of said drive shaft, pistons arranged to reciprocate in said cylinder bores, a wobble plate operated in response to rotation of said shaft and drivingly connected to said pistons, compressor output modulation means for varying the angle of said wobble plate relative to said drive shaft and thus the stroke of said pistons in said cylinder bores, and an expansible chamber type actuator including an axially movable member for actuating said modulation means, the improvement comprising in said modulation means a sleeve surrounding said drive shaft in sealing relation therewith and connected to said movable member for axial movement as a unit along the axis of said shaft while maintaining said sealing relation, a longitudinally extending slot in said sleeve, said wobble plate having a pivotal connection to said sleeve in line with the axis of said shaft for pivotal movement relative to said sleeve and said drive shaft during said axial movement of said sleeve to vary the angle of said wobble plate with respect to said drive shaft, and a radial lug on said drive shaft having a rotary driving connection to said wobble plate, said driving connection including means forming a cam track on said lug along the axis of said drive shaft, and a follower in said cam track interconnecting said wobble plate and said drive shaft and movable axially with respect to said lug in response to movement of said sleeve whereby said angle of said wobble plate is varied with respect to said drive shaft to infinitely vary the stroke of said pistons in said cylinder bores and thus the output of said compressor, said lug having a predetermined dimension relative to said slot such that when said lug is received in said slot a longitudinal clearance space is provided between said lug and the sides of said slot throughout the axial movement of said sleeve, said clearance space facilitating a direct rotary driving relation between said lug and said wobble plate while preventing a direct rotary driving relation between said shaft and said wobble plate at the pivotal connection of said wobble plate to said sleeve thereby to obviate torque load transfer between said shaft and said wobble plate at said pivotal connection.

2. In a variable output compressor having a housing, a cylinder block disposed in said housing, a circular drive shaft having its one end journaled in one wall of said housing and its other end journaled in said cylinder block, said cylinder block having a plurality of cylinder bores formed therein substantially parallel to the axis of said shaft, pistons arranged to reciprocate in said cylinder bores, a wobble plate operated in response to rotation of said shaft and drivingly connected to said pistons, compressor output modulation means for varying the angle of said wobble plate relative to said drive shaft and thus the stroke of said pistons, and an expansible chamber type actuator including an axially movable member for actuating said modulation means, the improvement comprising in said modulation means a sleeve surrounding said drive shaft in sealing relation therewith and connected to said movable member for axial movement as a unit along the axis of said shaft while maintaining said sealing relation, the connection of said movable member with said sleeve including a squaring shoulder and stop forming a sufficiently stable interrelationship therebetween to resist binding of said unit with said drive shaft, said wobble plate connected to said sleeve for pivotal movement relative thereto during said axial movement of said sleeve, a lug on said drive shaft in rotary driving relation to said wobble plate, means forming a cam track on said lug along the axis of said drive shaft, opposite ends of said cam track defining respectively maximum and minimum stroke lengths for each of said pistons in a manner to constrain said wobble plate to provide essentially constant top dead center positions for each of said pistons, a follower in said cam track interconnecting said wobble plate and said drive shaft and movable axially with respect to said lug and said wobble plate in response to movement of said sleeve whereby said angle of said wobble plate is varied with respect to said drive shaft to infinitely vary the stroke lengths of said pistons and thus the output of said compressor.

3. In a variable output compressor having a housing, a cylinder block disposed in said housing defining a crankcase therebetween for containing oil, front and rear heads disposed within opposite ends of said housing, a circular drive shaft having its front end rotatably journaled in said front head and its rear end journaled in said cylinder block, said cylinder block having a plurality of cylinder bores formed therein substantially parallel to the axis of said shaft, pistons arranged to reciprocate in said cylinder bores, a wobble plate operated in response to rotation of said shaft and drivingly connected to said pistons, the connection of said wobble plate to said pistons including a socket plate in relatively slidable interface relation with said wobble plate, compressor output modulation means for varying the angle of said wobble plate relative to said drive shaft and thus the stroke of said pistons, an expansible chamber actuator including an axially movable member for actuating said modulation means, an oil pump driven by said shaft, and oil inlet passage means for conducting oil from said crankcase to the inlet of said oil pump, the improvement comprising a sleeve surrounding said drive shaft in sealing relation therewith and connected to said movable member for axial movement as a unit along the axis of said shaft, said wobble plate having a pivotal connection to said sleeve to facilitate pivotal movement of said wobble plate relative to said sleeve during said axial movement of said sleeve, said pivotal connection including a hollow pivot pin interconnecting said wobble plate and said sleeve and extending from said shaft to the interface between said wobble plate and said socket plate, a lug on said drive shaft in rotary driving relation to said wobble plate, said shaft having longitudinally extending front and rear shaft passage portions, said front shaft passage portion being in communication with said expansible chamber and said rear shaft passage portion being in communication with the hollow of said pivot pin, first oil outlet passage means including means for controlling flow of oil from said pump to said expansible chamber for effecting the movement of said movable member, said first oil outlet passage means including a rear oil outlet portion located rearwardly of said wobble plate extending outwardly from the outlet of said pump to a point outboard of said cylinder bores, a front oil outlet portion located forwardly of said expansible chamber and extending inwardly into communication with the front shaft passage portion, and a longitudinally extending crossover portion disposed radially outboard of said wobble plate interconnecting said front and rear oil outlet portions; and second oil outlet passage means for carrying oil from said pump to said rear shaft passage portion for lubricating said interface through the hollow of said pivot pin.

4. In a variable output refrigerant compressor having a housing, a cylinder block disposed in said housing, a circular drive shaft having its one end journaled in one wall of said housing and its other end journaled in said cylinder block, said cylinder block having a plurality of cylinder bores formed therein substantially parallel to the axis of said shaft, pistons arranged to reciprocate in said cylinder bores and adapted thereby to pump a refrigerant to and from the condenser and evaporator of an automobile air conditioning system, a wobble plate operated in response to rotation of said shaft and drivingly connected to said pistons in a manner to receive a resultant piston force at a predetermined point on said wobble plate when refrigerant is being pumped, compressor output modulation means for varying the angle of said wobble plate relative to said drive shaft and thus the stroke of said pistons in said bores to vary the amount of refrigerant pumped, an expansible chamber type actuator including an axially movable member for actuating said modulation means in response to a controlled pressure in said chamber, and means in unavoidable limited communication with said refrigerant for pumping lubricant in said housing to said chamber in a controlled amount to provide the controlled pressure for actuating said modulation means, said lubricant occasionally escaping said housing and becoming commingled with said refrigerant to the point where the lubricant pumping means has insufficient lubricant in said housing to provide said controlled pressure, the improvement comprising in said modulation means a sleeve circumscribing said drive shaft in sealing relation therewith and connected to said movable member for axial movement as a unit along the axis of said drive shaft in response to said controlled pressure while maintaining said sealing relation, the connection of said movable member with said sleeve including means forming a sufficiently stable interrelationship therebetween to resist binding of said unit with said drive shaft, said wobble plate having a pivotal connection to said sleeve in line with the axis of said drive shaft for pivotal movement relative to said sleeve and said drive shaft during said axial movement of said sleeve, a radial lug on said drive shaft in rotary driving relation to said wobble plate, means forming a cam track on said lug along the axis of said drive shaft and radially more remote from the axis of said drive shaft than the predetermined point of resultant piston force on said wobble plate, said cam track configured to constrain said wobble plate to provide essentially constant top-dead-center positions for each of said pistons at one end of said stroke, a follower in said cam track interconnecting said wobble plate and said drive shaft and movable axially with respect to said lug in response to movement of said sleeve by said controlled pressure whereby said angle of said wobble plate is varied with respect to the axis of said drive shaft within the limits of said cam track to infinitely vary the stroke lengths of said pistons and thus the output of said compressor, and said follower movable radially with respect to the axis of said drive shaft in response to a pivotal movement of said wobble plate caused to happen by said resultant piston force in the absence of said controlled pressure whereby the angle of said wobble plate is progressively varied with respect to the axis of said drive shaft toward providing maximum stroke length for said pistons to maximize the amount of refrigerant pumped so that escaped lubricant will be returned to said compressor from said condenser and evaporator so as occasionally to return to said housing because of said limited communication so said lubricant pumping means can reestablish said controlled pressure.

5. In a variable output refrigerant compressor having a housing, a cylinder block disposed in said housing, a drive shaft rotatable in said housing, a cylinder block having a plurality of cylinder bores formed therein substantially parallel to the axis of said shaft, pistons arranged to reciprocate in said cylinder bores and adapted thereby to pump a refrigerant to and from the condenser and evaporator of an air conditioning system, a wobble plate operated in response to rotation of said shaft and drivingly connected to said pistons in a manner to receive a resultant force at a predetermined point on said wobble plate when refrigerant is being pumped, compressor output modulation means for varying the angle of said wobble plate relative to said drive shaft and thus the stroke of said pistons in said bores to vary the amount of refrigerant pumped, an expansible chamber type actuator including an axially movable member for actuating said modulation means in response to a controlled pressure in said chamber, and means in unavoidable limited communication with said refrigerant for pumping lubricant in said housing to said chamber in a controlled amount to provide the controlled pressure for actuating said modulation means, said lubricant occasionally escaping said housing and becoming commingled with said refrigerant to the point where the lubricant pumping means has insufficient lubricant in said housing to provide said controlled pressure, the improvement comprising in said modulation means a sleeve on said drive shaft in sealing relation therewith and connected to said movable member for axial movement as a unit along the axis of said drive shaft in response to said controlled pressure while maintaining said sealing relation, the connection of said movable member with said sleeve including means forming a sufficiently stable interrelationship therebetween to resist binding of said unit with said drive shaft, said wobble plate having a pivotal connection to said sleeve in line with the axis of said drive shaft for pivotal movement relative to said sleeve and said drive shaft during said axial movement of said sleeve, lug means on said drive shaft in rotary driving relation to said wobble plate, cam means on said lug means effective radially outboard of said predetermined point of resultant piston force on said wobble plate for defining the angle variation of said wobble plate, follower means interrelating with said cam means for interconnecting said wobble plate and said lug means and movable with respect to said lug means in response to movement of said sleeve by said controlled pressure whereby said angle of said wobble plate is varied with respect to said lug means within the limits defined by said cam means to infinitely vary the stroke lengths of said pistons and thus the output of said compressor, and said follower means movable radially with respect to said lug means in response to a pivotal movement of said wobble plate caused to happen by said resultant piston force in the absence of said controlled pressure, the movement of said wobble plate because of such radial movement of the follower means increasing the radially outboard effectiveness of said follower means with respect to said resultant force whereby the angle of said wobble plate is progressively more forcefully varied with respect to said lug means toward providing maximum stroke length for said pistons to maximize the amount of refrigerant pumped so that escaped lubricant will be returned to said compressor from said condenser and evaporator so as occasionally to return to said housing because of said limited communication so said lubricant pumping means can reestablish said controlled pressure.

* * * * *